US005367279A

United States Patent [19]

Sakai

[11] Patent Number: 5,367,279

[45] Date of Patent: Nov. 22, 1994

[54] OVERCURRENT PROTECTION DEVICE

[75] Inventor: Akira Sakai, Ami, Japan

[73] Assignee: Texas Instruments Incorporated, Dallas, Tex.

[21] Appl. No.: 33,706

[22] Filed: Mar. 16, 1993

[30] Foreign Application Priority Data

Mar. 30, 1992 [JP] Japan ..... 4-105482

[51] Int. Cl.[5] ..... H01H 61/02; H01H 71/16

[52] U.S. Cl. ..... 337/104; 337/107; 361/23; 361/32; 361/105

[58] Field of Search ..... 337/101, 102, 103, 104, 337/105, 106, 107; 361/23, 24, 25, 26, 32, 34, 105; 219/511

[56] References Cited

U.S. PATENT DOCUMENTS 4,295,114 10/1981 Pohl ..... 337/3
4,319,126 3/1982 Lujie ..... 219/512
4,472,705 9/1984 Carlson ..... 337/299
4,580,123 4/1986 Roller et al. ..... 337/103
4,876,523 10/1989 Kushida et al. ..... 337/299
5,039,843 8/1991 Müller ..... 337/104

*Primary Examiner*—Harold Broome
*Attorney, Agent, or Firm*—Russell E. Baumann; Richard L. Donaldson; René E. Grossman

[57] ABSTRACT

An overcurrent protection device 10 has a fixed 26 and a movable 32 contact electrically connected to a pair of terminals 14, 16 and a snap acting bimetallic member 34 which is responsive to a thermally resistive element 28, connected in series with the contacts between the terminals to cause the contacts to move from an engaged position to a disengaged position. The device further includes a current bypass path 24 adapted to be connected in parallel with the thermally resistive element 28 and a second thermally responsive bimetal member 24 *b* to cause the electrical connection. Additionally, a heater block 18 can be provided between the terminals 14, 16 which has a resistance significantly higher than that of the thermal resistive element 28.

11 Claims, 5 Drawing Sheets

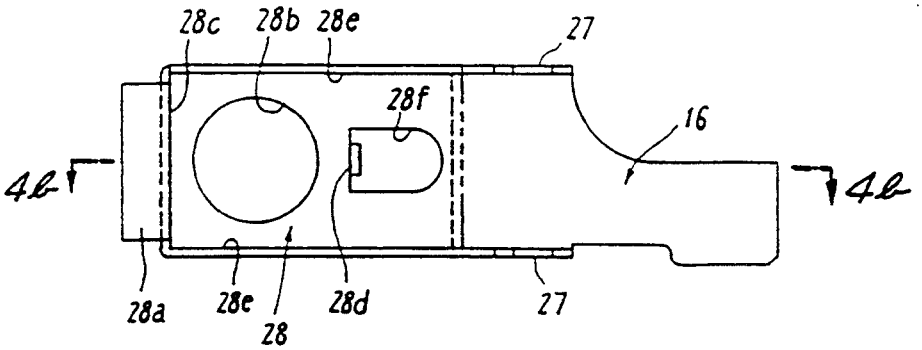
FIG. 4a.
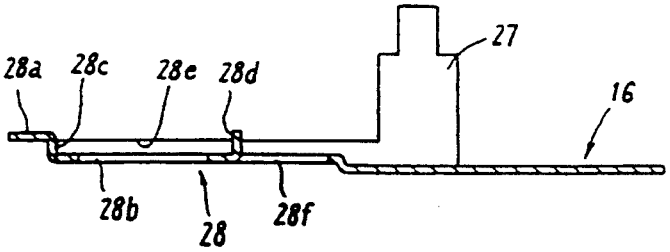
FIG. 4b.
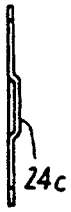
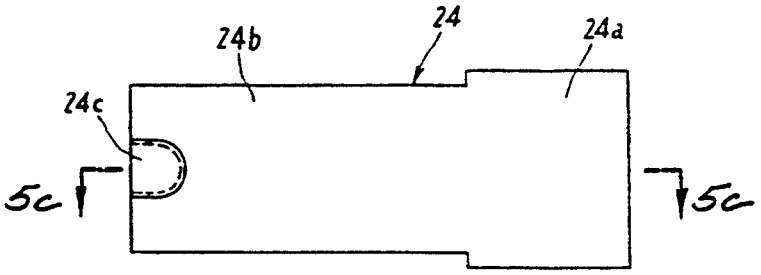
FIG. 5b. FIG. 5a.
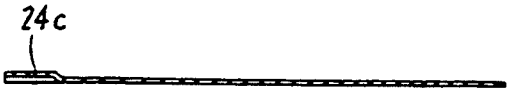
FIG. 5c.

OVERCURRENT PROTECTION DEVICE

BACKGROUND INVENTION

This invention relates to an overcurrent protection device, and more particularly to an overcurrent protection device for protecting electrical appliances from overcurrent.

In motor driven electrical machines and devices when moving parts are clogged and stop due to the accumulation of dust and ice, or the action of outside forces, overloading occurs which causes a current flow much higher than the rated value with the consequence that coils or other parts may burn. As is known in the art and shown in FIG. 13, an overcurrent protection device P is placed in the current sourcing circuit of the electrical machine, such as a motor M, and this overcurrent protection device P can cut off the circuit when the current becomes higher than a prescribed level.

In the prior art, a current-type fuse was used as this type of overcurrent protection device P. As shown in FIG. 14 for motor M, which has a rated operating current of $I_R$: if the motor "locks up" at time $t_f$ and becomes overloaded, overcurrent $I_l$ flows and the resulting heat opens current-type fuse P, and the electrical current in the circuit is cut off. In this way, as current-type fuse P cuts off the electric circuit, electric motor M is protected. A major drawback, however, with the use of a current-type fuse is the fact that each time the electric circuit is cut off, a new current-type fuse must be installed, a rather tedious process for the user.

A thermostat and temperature-type fuse may be used as a means to replace the current-type fuse. Such devices can detect overheating of an electrical machine and then cut off the electric circuit. However, with conventional thermostats, after the electric circuit is cut off, the electric circuit often is closed (reconnected) again whether or not the aforementioned electric machine has sufficiently cooled. Consequently, there can be a cycling overcurrent flow situation which is a problem. In addition, faulty operation may take place when the surrounding temperature rises, although no current actually flows. For the temperature-type fuse, just as in the case of the current-type fuse, each time the electric circuit is cut off, a new fuse must be installed. This, of course, is an inconvenience.

SUMMARY OF THE INVENTION

The purpose of this invention is to solve the problems of the conventional type protection devices by providing an overcurrent protection device characterized by the fact that there is no need to replace the overcurrent protection device each time the electric circuit is cut off due to the fact that it has a self-holding function which enables it to maintain the cut-off state after the overcurrent condition has been detected. Another purpose of this invention is to prevent the faulty cut-off of the electric current when the current flow in the machine being protected is at an acceptable rated current flow.

Accordingly, an overcurrent protection device of this invention comprises a fixed contact electrically connected to a first terminal, a movable contact connected to a second terminal adapted to engage and disengage with the fixed contact, a thermally resistive element connected in series to the fixed and movable contacts between the first and second terminals, a thermally responsive snap-acting first bimetal member positioned near said thermal resistive element which moves from a first position to a second position upon being heated to a first prescribed temperature, said second position causing the disengagement of said movable and said fixed contacts, a current bypass means adapted to be connected in parallel with said thermally resistive element, and a second thermally responsive bimetal member positioned near said thermal resistive element adapted to electrically connect said current bypass means in parallel with said thermal resistive element when heated to a second prescribed temperature lower than the first prescribed temperature associated with the first bimetal member.

With the overcurrent protection device, when the rated current flows in the machine/motor, the temperature in the vicinity of the thermal resistive element rises, due to the accumulation of heat and/or rise in ambient temperature. Upon such temperature reaching a prescribed level, the second bimetal member functions to connect the current bypass means in parallel with the thermal resistive element. In this way, the resistive heating rate of the thermal resistive element is reduced and the heating effect on the first bimetal member is suppressed. Consequently, in the case of rated current operation, there is no faulty operation in which the fixed and movable contacts are opened. On the other hand, when current surges are encountered, the heating rate of the thermal resistive element does provide the predetermined temperature to the first bimetal member to activate and open the contacts. In this way, the overcurrent is cut off and burning of the electrical machine or part is prevented.

In accordance with a second aspect of this invention, an overcurrent protection device comprises a fixed contact electrically connected to a first terminal, a movable contact connected to a second terminal adapted to engage and disengage with the fixed contact, a thermally resistive element connected in series to the fixed and movable contacts between first and second terminals , a thermally snap-acting bimetal member positioned near said thermal resistive element which moves from a first position at a first prescribed temperature to a second position causing the disengagement of said movable and said fixed contacts, a current bypass means connected in parallel with said thermally resistive element adapted to electrically connect said current bypass means in parallel with said thermal resistive element when heated to a prescribed temperature, and a heating means adjacent said bimetal member connected between the first and second terminals, said heating means having a resistance significantly higher than that of said thermal resistive element.

In accordance with this second device, upon the opening of the contacts the current (now at a very low level) flows through the high resistance heating block which supplies heat sufficiently to the first bimetal member to keep it in the inverted state (contacts open). This self-holding (contacts open) state can be released when the system switch external to the protector is opened so no voltage is applied between the two terminals of the protector.

DESCRIPTION OF THE DRAWINGS

Other objects, advantages and details of the overcurrent protection device of this invention appear in the following detailed description of the preferred embodiments of the invention, the detailed description referring to the drawings in which:

FIG. 4*a* is a top view illustrating the configuration of the fixed bracket of the overcurrent protection device of FIG. 1;

FIG. 4*b* is a cross-sectional view cut along line 4—4 of FIG. 4*a;*

FIG. 5*a* is a top view of the second bimetallic member of the overcurrent protection device of FIG. 1;

FIG. 5*b* is a left side view of FIG. 5*a;*

FIG. 5*c* is cross-sectional view cut along line 5—5 in FIG. 5*a;*

FIG. 7 is an electric circuit diagram with the overprotection device of FIG. 1 and illustrating the state before and immediately after the power source is turned on;

DETAILED DESCRIPTION OF THE PREFERRED EMBODIMENTS

Figure 1:
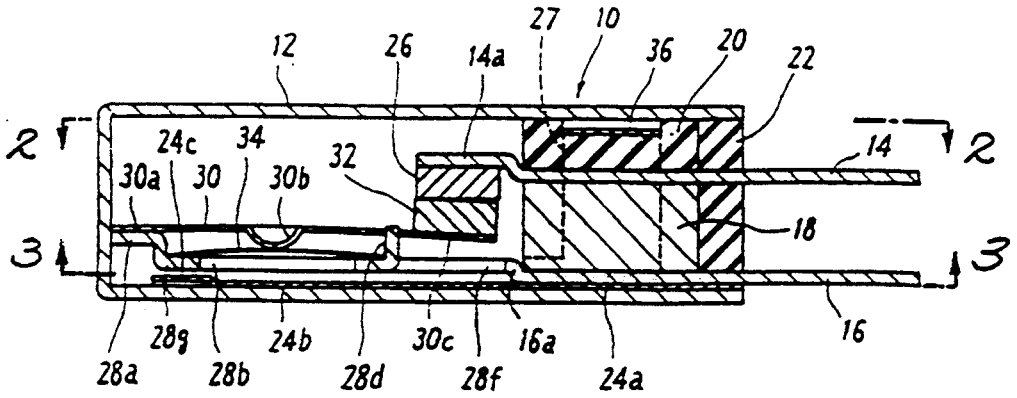
FIG. 1 is a cross-sectional view illustrating the overall configuration of the overcurrent protection device of the present invention.

Overcurrent protection device 10 as shown in FIG. 1 has a cylindrical housing 12 made of aluminum or the like. The overcurrent protection mechanism of device 10 is generally contained within housing 12. From the bottom of housing 12 (right end in FIG. 1) two terminals 14, 16 made of brass or the like extend outwardly. The bottom of the housing 12 has an opening which contains a heating block 18 made of an electroconductive material such as an electroconductive phenol and an insulation 20 typically made from a conventional phenol. Additionally, an epoxy adhesive 22 is used to seal the housing from the outer side. First terminal 14 is held between heating block 18 and insulator 20, and second terminal 16 and a base portion 24*a* of a second bimetal member 24 (discussed further below) are held between heating block 18 and the side surface of housing 12.

On the inside of housing 12, a fixed contact 26 made of, for example, a silver alloy, is fixed on a base portion 14*a* of first terminal 14. A thermal resistive element 28 typically metallic is also contained within housing 12 extending from base portion 16*a* of second terminal 16 toward the closed end of housing 12. On a tip portion 28*a* of thermal resistive element 28, a base portion 30*a* of a movable arm 30 is attached as by welding. Movable arm 30 is made from a resilient electrically conductive material such as beryllium copper. At the distal end 30*c* of arm 30 a movable contact 32 made of, for example, a silver alloy is fixed directly opposite fixed contact 26, and as shown in FIG. 1, in engagement with fixed contact 26.

Accordingly, second terminal 16 and thermal resistive element 28 forms an integrated bracket member. The configuration of the fixed bracket member will be explained below with reference to FIGS. 4*a* and 4*b*. FIG. 4*a* is a top view of this fixed bracket and FIG. 4*b* is a cross-sectional view cut along line 4—4 of FIG. 4*a*. In FIG. 4*a*, a circular opening 28*b* is formed at the central portion of thermal resistive element 28. Adjacent one portion of this opening 28*b*, a tip portion 28*a* of thermal resistive element 28 forms stepwise wall portion 28*c* . 0n the opposite side of opening 28*b* from wall portion 28*c* is a small wall portion 28*d* which protrudes upward and also side wall portions 28*e* on the side edge of the thermal resistive element 28 are provided. By means of these four wall portions 28*c*, 28*d*, 28*e*, 28*e*, the configuration and location of temperature responsive first main bimetal member 34 (to be explained below) is defined. On thermal resistive element 28, a U-shaped opening 28*f* is placed in the vicinity of protruding wall portion 28*d*. Due to this opening 28*f*, since the area of thermal resistive element 28 is reduced, the resistance of thermal resistive element is increased; and thus, the rate of resistive heating of the thermal resistive element in this area is increased. A part 27 extending in a direction generally perpendicular to second terminal 16 at one end of side wall portion 28*e* is a pressing plate for fixing heating block 18 and insulator 20 to the fixed bracket.

Figure 2:
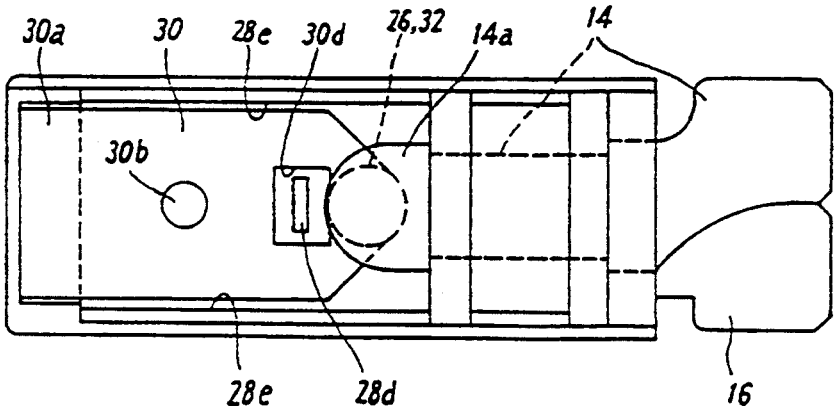
FIG. 2 is a planar view cut along line 2—2 in FIG. 1.
Figure 3:
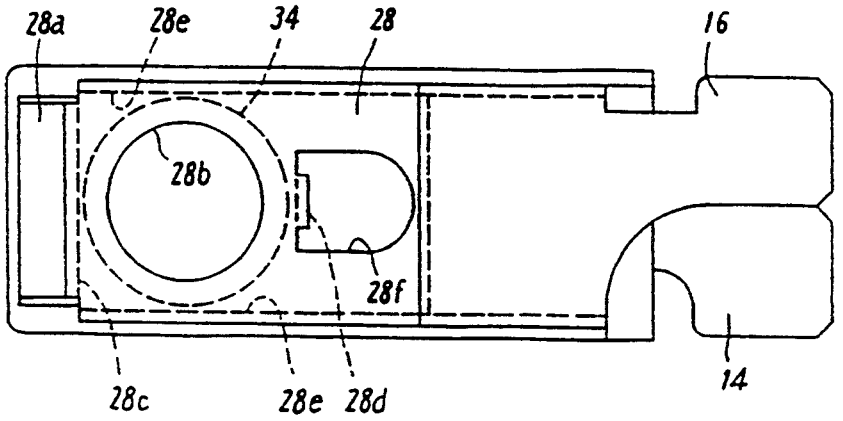
FIG. 3 is a bottom view cut along line 3—3 in FIG. 1.

As shown in FIG. 1, a first main bimetallic member 34 of a generally circular shape is set on circular opening 28*b* of thermal resistive element 28. The sides of bimetallic member 34 are surrounded by the four walls 28*c*, 28*d*, 28*e*, 28*e* of the fixed bracket so that it is generally fixed in the transverse direction. In addition, member 34 is always contacted and pressed from the upper side by a semispherical protrusion 30*b* of movable arm 30. As shown in FIG. 2, in movable arm 30, an opening 30*d* is arranged for passage through the small wall portion 28*d* of the fixed bracket.

On the lower side (inner side) of thermal resistive element 28, movable portion 24*b* of second bimetal member 24 is positioned parallel to thermal resistive element 28. This bimetal member can be made from conventional bimetal materials. As shown in FIG. 5, it has a nearly rectangular shape with a convex shaped contact portion at its tip or distal end. In this embodiment, second bimetal member 24 also plays the role of a current bypass means.

Figure 6A:
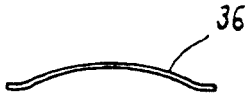
FIG. 6*a* is a side view of leaf spring (36) of the overcurrent protection device of FIG. 1.
Figure 6B:
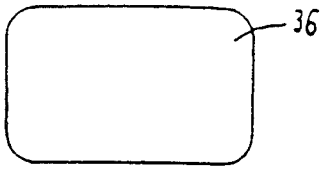
FIG. 6*b* is a top view of FIG. 6*a;*

As shown in FIG. 1, sheet 36 arranged on insulator 20 is a leaf spring made of, for example, stainless steel. As shown in FIG. 6*a*, this leaf spring 36 is originally a bent sheet. However, when the tip of pressing sheet 27 of the fixed bracket moves, leaf spring 36 is held and pressed on insulation 20, and the leaf spring 36 is deformed to the flat shape as shown in FIG. 6*b* and FIG. 1. By means of the reactive force (the elastic recovery force) of this leaf spring 36 deformed to the flat shape, heating block 18 is held between first and second terminals 14, 16 with sufficient pressure. In this way, a good electrical contact can be made.

Figure 7:
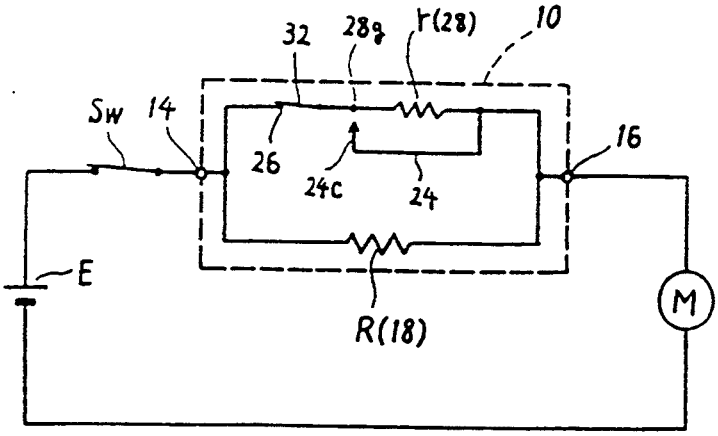
Figure 8:
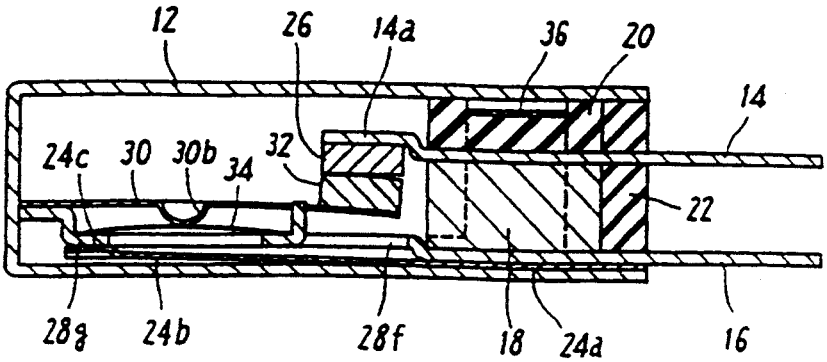
FIG. 8 is a cross-sectional view illustrating the state of normal rated operation of the overcurrent protection device of the present application.
Figure 9:
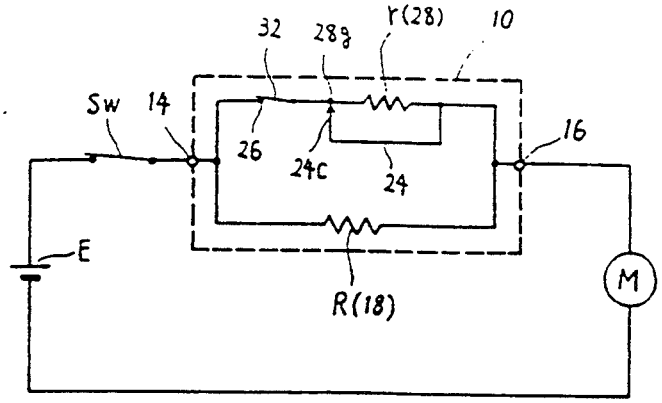
FIG. 9 is an electric circuit diagram similar to FIG. 7 but illustrating the state of normal rated operation of the overcurrent protection device.
Figure 10:
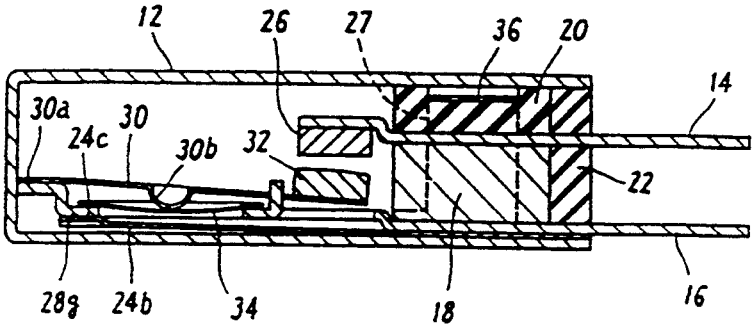
FIG. 10 is a cross-sectional view illustrating the contacts in the open, cut-off state of the overcurrent protection device of the present invention.
Figure 11:
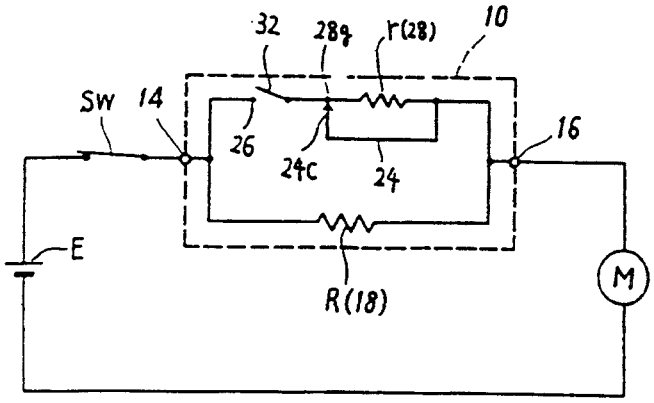
FIG. 11 is an electric circuit diagram similar to FIG. 7 illustrating the cut-off state of the overcurrent protection device.
Figure 12:
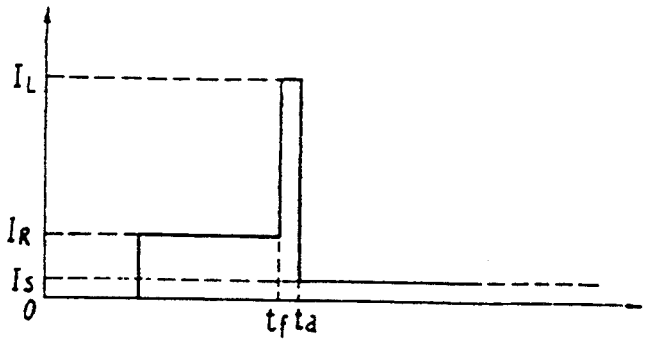
FIG. 12 is a timing diagram illustrating the operation of the overcurrent protection device of FIG. 1.
Figure 13:
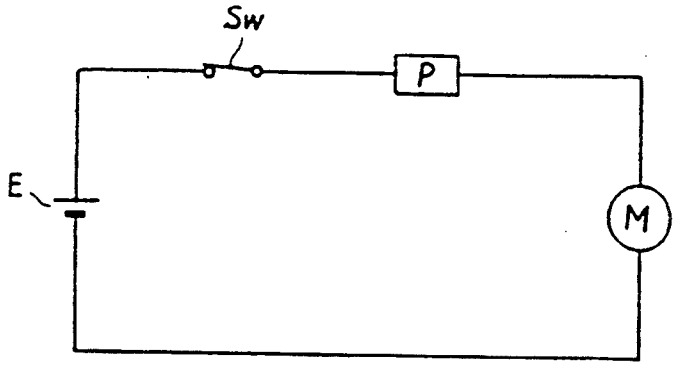
PRIOR ART FIG. 13.
FIG. 13 is a typical electric circuit diagram of an overcurrent protection device of the prior art.
Figure 14:
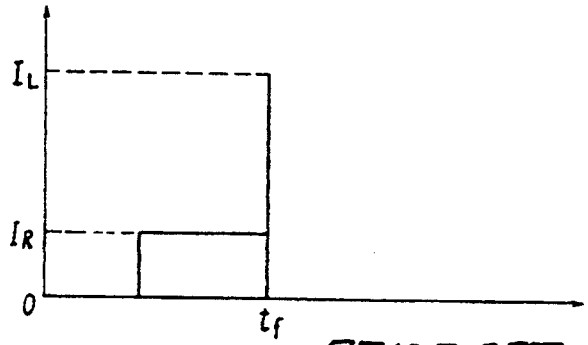
PRIOR ART FIG. 14.
FIG. 14 is a timing diagram illustrating the function of a prior art current-type fuse overcurrent protection device.

With reference to FIGS. 1 and 7–12, the function of the overcurrent protection device of this embodiment will be explained. FIG. 1 shows the state of this overcurrent protection device 10 before and immediately after the power source is turned on. FIG. 7 is a circuit diagram corresponding to the state shown in FIG. 1. FIG. 8 shows the state of this overcurrent protection device when normal rated current flows. FIG. 9 is the electric circuit diagram corresponding to the state shown in FIG. 8. FIG. 10 shows the state of this overcurrent protection device 10 after cut off (contacts are open). FIG. 11 is an electric circuit diagram corresponding to the state shown in FIG. 10. In FIGS. 7, 9 and 11, E represents a DC power source, Sw represents a manual system switch, M represents an electrical machine or device, such as a DC motor, R represents the resistance of heating block 18, and r represents the resistance of thermal resistive element 28. FIG. 12 shows a timing diagram illustrating the operation of this overcurrent protection device 10. This overcurrent protection device 10 is placed near motor M.

Before system switch Sw is closed, in this overcurrent protection device 10, as shown in FIG. 1, main bimetal 34 is in its original state, that is, in the state of being bowed upwardly; hence, movable arm 30 is positioned upwardly, and movable contact 32 is pressed into contact with fixed contact 26. As shown in FIG. 1, movable portion **24*b* of second bimetal member 24 is in the original state, that is, a state nearly colinear with base portion 24*a*, and contact point portion 24*c* of second bimetal member 24 is not in contact with bottom surface contact portion 28*g* of thermal resistive element 28**.

When switch Sw is closed in this state, the current entering the first terminal (14) from power source E through switch Sw flows through fixed contact 26, movable contact 32, movable arm 30, and thermal resistive element 28 and away through second terminal 16 to motor M. Since current flows through this overcurrent protection device 10, joule heat (resistive heat) is generated at the various locations of the current path. In particular, the heat generated from thermal resistive element 28 is important. Hence, as to be explained later, the heat acts on first main bimetal member 34 and second bimetal member 24. Since resistance R of heating block 18 is much larger (by several hundred times) than the resistance value r of thermal resistive element 28, as long as the current flows in thermal resistive element 28 (when contacts 32, 26 are closed), heating block 18 acts as a virtual insulator, with no current flowing through it. Hence, no heating takes place in heating block 18.

As normal rated current $I_R$ flows, the heat generated by thermal resistive element 28 accumulates in device 10, and the ambient temperature of device 10, in particular, the temperature of the winding of motor M, rises; hence, movable part **24*b* of second bimetal member 24 bends upwardly. When heating is carried out to a prescribed operating temperature, as shown in FIG. 8, contact portion 24*c* of second bimetal member 24 comes in contact with bottom contact portion 28*g* of thermal resistive element 28. As shown in FIG. 9, due to contact between these contact portions 24*c*, 28*g*, second bimetal member 24 is connected as a current bypass means in parallel with thermal resistive element 28. As a result, a portion of the current flowing through two contacts 26, 32 is diverted to current bypass means 24, and the current flowing through thermal resistive element (28) is reduced significantly, for example, it may be halved. Consequently, even when rated current $T_R$ continued flowing for a long period of time, the heating of thermal resistive element 28 can still be suppressed, and main bimetal 34** can maintain its original state.

With reference to FIG. 12, if motor M is overloaded for some reason at time point $t_f$: the current rises drastically, the heat generated from thermal resistive element 28 increases, and the temperature of the winding of motor M also increases abnormally. As a result, first main bimetal member 34 snaps to its inverted position at the prescribed temperature, and it reaches the downward reversed state as shown in FIG. 10. Consequently, the central portion of first bimetal member 34 moves into circular opening **28*b* of thermal resistive element 28, and thus, movable arm 30 moves so that movable contact 32 is separated from fixed contact 26. Since first bimetal member 34 is pressed by semispherical shaped protrusion portion 30*b* of movable arm 30**, the inversion from the original state to the reversed state occurs in a single snap action.

In this way, since the circuit is cut off between two contacts 32, 26, no current flows in thermal resistive element 28. Instead, heating block 18 between first and second terminals 14, 16 acts as a thermal resistive element, and heating block 18 is heated to an electrical power of, for example, about 10 W. Due to the heating of heating block 18, the heating of main bimetal 34 continues even after cut off, and the reversed state shown in FIG. 10 is maintained. For second bimetal member 24, due to heating by heating block 18, the contact state between thermal resistive element 28 and bottom contact portion 28 can be maintained. Or, due to the presence of thermal resistive element 28, the heat from heating block 18 does not significantly reach the second bimetal member, and the original state shown in FIG. 1 may be recovered. In any case, the state of secondary bimetal 24 after cut off is not important to the operation of this overcurrent protection device 10, and any design may be adopted in this respect.

As explained above, since heating block 18 acts as a resistor, the current continues flowing in the electric circuit even after cut off between the two contacts 32, 26. Since the current I, is much smaller than the rated current, motor M virtually stops. When the user opens system switch Sw to service the motor, no current flows through this overcurrent protection device 10, the heating of heating block 18 stops, main bimetal 34 and secondary bimetal 24 return to their original positions, and movable contact 32 resumes its original orientation and is pressed in contact with fixed contact 26 (that is, the state shown in FIG. 1).

In overcurrent protection device 10 of the present invention, the position of first bimetal member 34 is switched, and connection/disconnection between fixed contact 26 and movable contact 32 is carried out. Consequently, the situation differs from that of the current-type fuse in that the same device can be used to cut off the overcurrent flow many times without the need of exchange of parts for each cut off operation. In addition, it has the self-holding breaker means since the cut off state is maintained due to the action of heating block 18 even after the overcurrent flow is cut off. That is, device 10 will not automatically reset after a cool down period as is standard in prior art protectors. Consequently, the protection of the electrical device or machine M can be maintained. In addition, when the rated current flows, the temperature near thermal resistive element 28 rises due to the accumulation of heat or the rise in ambient temperature. In this case, second bimetal 24 acts as a current bypass means since it is connected in parallel to thermal resistive element 28. In this way, the heating of thermal resistive element 28 can be suppressed, and faulty operation of first bimetal 34 can be prevented. Thus, there is no danger of cut off of contacts 32, 26 due to the faulty operation, and the reliability of the overcurrent protection device is greatly improved. Still further, first bimetal 34 is made of a circular plate shaped rebounding type bimetal, and first material 34 is energized by means of depression portion **30*b* of movable arm 30, so that main bimetal 34** can perform the reverse operation instantly, thus enabling high-speed snap-acting cut off.

In the above example, movable arm 30 and first bimetal member 34 are formed as separate parts, and movable arm 30 and movable contact point 32 are driven by main bimetal 34. However, it is also possible to form an integrated part with the main bimetal also acting as the movable arm. In the aforementioned example, second bimetal member 24 and the current bypass means are formed as an integrated part. However, it is also possible to form them as separate parts. It is also possible to use a single bimetal to act as both the first and second bimetal members. That is, the bimetals are so designed that they increase approximately linearly with the heating temperature. At the first displacement position, the bimetal is connected as a current means in parallel to the thermal resistive element. Then, at the second and larger displacement position, the movable contact point is separated from the fixed contact point. By changing the shapes and sizes of thermal resistive element 28 and concave portion **28*f*, it is possible to change the heating characteristics and response characteristics to the current as desired. It is also possible to connect thermal resistive element 28 in series with fixed contact 26, instead of the series connection with movable contact point 32. By replacing heating block 18** with a conventional insulating material, it is possible to form an automatic overcurrent protection device which can recover the original state or current-on state soon after the cut off operation.

Accordingly, the overcurrent protection device of the present invention provides for a device which prevents the occurrence of a faulty condition when operation of the electrical circuit and machine are within rated operating conditions; and in the event of a faulty condition, maintains the cut-off (contacts open) until the circuit has been totally deenergized. Additionally, there is no requirement of new parts each time an electric circuit fault condition occurs.

It should be understood that although particular embodiments of this invention have been described by way of illustrating the invention, the invention includes all modifications and equivalences of the disclosed embodiments falling within the scope of the appended claims.

I claim:

1. An overcurrent protection device comprising a fixed contact electrically connected to a first terminal, a movable contact connected to a second terminal adapted to engage and disengage with the fixed contact, a thermally resistive element connected in series to the fixed and movable contacts between the first and second terminals, a thermally responsive snap-acting first bimetal member positioned near said thermally resistive element which moves from a first position to a second position upon being heated to a first prescribed temperature, said second position causing the disengagement of said movable and said fixed contacts, a current bypass means adapted to be connected in parallel with said thermally resistive element, and a second thermally responsive bimetal member positioned near said thermally resistive element adapted to electrically connect said current bypass means in parallel with said thermally resistive element when heated to a second prescribed temperature lower than the first prescribed temperature associated with the first bimetal member.

2. The overcurrent protection device of claim 1 further including heating means adjacent said bimetal member connected between the first and second terminals.

3. The overcurrent protection device of claim 2 wherein said heating means has a resistance significantly higher than that of said thermally resistive element.

4. The overcurrent protection device of claim 2 wherein said heating means has a resistance at least about two hundred times that of said thermally resistive element.

5. The overcurrent protection device of claim 2 wherein said heating means is made from an electroconductive material having a relatively high resistance as compared to said thermally resistive element.

6. The overcurrent protection device of claim 1 wherein said second thermally responsive bimetal member is a bimetallic strip.

7. An overcurrent protection device comprising a fixed contact electrically connected to a first terminal, a movable contact connected to a second terminal adapted to engage and disengage with the fixed contact, a thermally resistive element connected in series to the fixed and movable contacts between the first and sound terminals, a thermally snap-acting bimetal member positioned near said thermally resistive element which moves from a first position to a second position at a first prescribed temperature causing the disengagement of said movable and said fixed contacts, a current means connected in parallel with said thermally resistive element electrically connecting said first and second terminals including a heating means adjacent said bimetal member connected between the first and second terminals, said heating means having a resistance significantly higher than that of said thermal resistive element.

8. The overcurrent protection device of claim 7 further including a current bypass means adapted to be connected in parallel with said thermally resistive element and means for electrically connecting said circuit bypass means in parallel with said thermally resistive element when heated to a second prescribed temperature lower than the first prescribed temperature.

9. The overcurrent protection device of claim 8 wherein said heating means has a resistance at least about two hundred times that of said thermally resistive element.

10. The overcurrent protection device of claim 7 wherein said heating means is made from an electroconductive material having a relatively high resistance as compared to said thermally resistive element.

11. An overcurrent protection device comprising a fixed contact electrically connected to a first terminal a movable contact connected to a second terminal adapted to engage and disengage with the fixed contact, a thermally resistive element connected in series to the fixed and movable contacts between the first and second terminals, a thermally responsive snap-acting bimetal member positioned near said thermally resistive element which moves from a first position to a second position upon being heated to a first prescribed temperature, said second position causing the disengagement of said movable and said fixed contacts a current bypass means adapted to be connected in parallel with said thermally resistive element, and means for electrically connecting said current bypass means in parallel with said thermally resistive element when said bimetal member is heated to a second prescribed temperature lower than the first prescribed temperature.

* * * * *